US005687713A

United States Patent [19]

Bahr et al.

[11] Patent Number: 5,687,713

[45] Date of Patent: Nov. 18, 1997

[54] BREATHING MASK

[76] Inventors: Erik W. Bahr, Fugleveien 5, N-1440 Drøbak; Øystein Ljungmann, Elgfaret 15, N-1404 Siggerud; Nils Kvandal, Orreveien 3B, N-1415 Oppegård; Vigbjørn Matre, Ormerudveien 59A, N-1410 Kolbotn, all of Norway

[21] Appl. No.: 558,948

[22] Filed: Nov. 13, 1995

Related U.S. Application Data

[63] Continuation of Ser. No. 244,232, filed as PCT/NO92/00186, Nov. 26, 1992 published as WO93/10858, Jun. 10, 1993, abandoned.

[30] Foreign Application Priority Data

Nov. 29, 1991 [NO] Norway ..... 914695

[51] Int. Cl.[6] ..... A62B 18/04

[52] U.S. Cl. ..... 128/206.21; 128/201.28; 128/204.18; 128/205.13; 128/205.22; 128/205.25

[58] Field of Search ..... 128/201.19, 201.22, 128/201.24, 201.28, 204.18, 205.13, 205.21, 205.22, 205.25, 206.24, 206.26, 206.23, 206.25

[56] References Cited

U.S. PATENT DOCUMENTS

| | | | |
|---|---|---|---|
| 409,428 | 8/1889 | Riehet | 128/201.19 |
| 1,105,127 | 7/1914 | Drager | 128/206.26 |
| 2,410,454 | 5/1946 | Motsinger | 128/201.19 |
| 2,444,417 | 7/1948 | Biexoran | 128/201.19 |
| 2,588,516 | 2/1952 | Glidden | 128/201.19 |
| 3,149,632 | 9/1964 | Colley | 128/201.24 |
| 3,167,069 | 1/1965 | Lobelle | 128/201.24 |
| 3,392,724 | 7/1968 | Cowley | 128/205.21 |
| 3,491,752 | 1/1970 | Cowley | 128/205.22 |
| 3,910,269 | 10/1975 | Ansite et al. | 128/201.24 |
| 4,000,883 | 1/1977 | Little et al. | 128/201.22 |
| 4,173,200 | 11/1979 | Ratz et al. | 128/201.28 |
| 4,211,220 | 7/1980 | O'Neill | 128/201.28 |
| 4,336,799 | 6/1982 | Almasi et al. | 128/201.28 |
| 4,595,003 | 6/1986 | Shoemaker et al. | 128/201.19 |
| 4,896,665 | 1/1990 | Geravis | 128/201.22 |
| 4,907,584 | 3/1990 | McGinnie | 128/206.24 |
| 4,938,211 | 7/1990 | Takahashi et al. | 128/205.22 |
| 5,181,506 | 1/1993 | Tardiff, Jr. et al. | 128/201.22 |
| 5,269,296 | 12/1993 | Landis | 128/207.18 |

FOREIGN PATENT DOCUMENTS

| | | | |
|---|---|---|---|
| 3537095 | 10/1985 | Germany | 2/424 |
| 2220574 | 1/1996 | United Kingdom | 128/201.22 |
| 9419055 | 9/1994 | WIPO | 128/201.24 |

*Primary Examiner*—Vincent Millin
*Assistant Examiner*—V. Srivastava
*Attorney, Agent, or Firm*—Abelman, Frayne & Schwab

[57] ABSTRACT

A breathing mask to be placed on a user's head includes a pressure gas container in the form of one or more closed communicating tubes which form a closed or a open ring adapted to encircle the user's face in front of the user's ears, a sealing member preferably being connected in serial arrangement with a pressure reduction valve and an airtight chamber of the mask.

13 Claims, 3 Drawing Sheets

Figure 1:
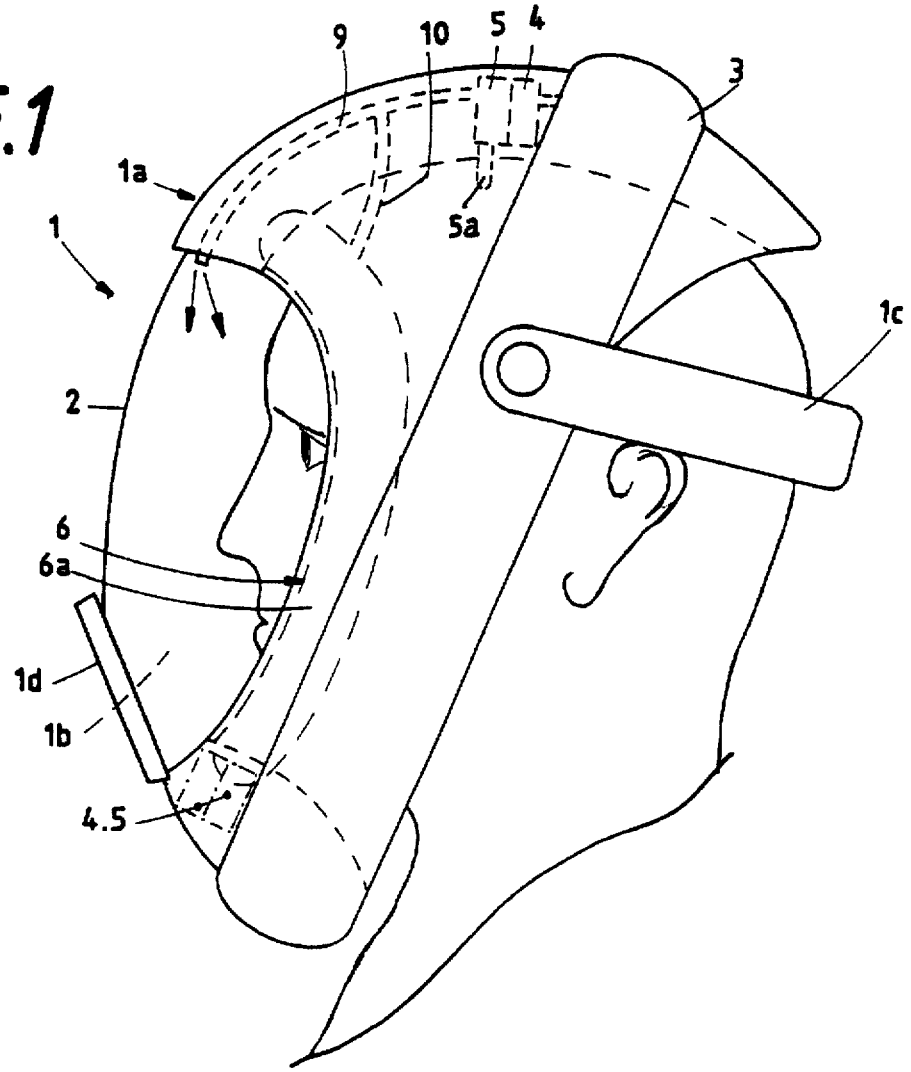

FIG 6
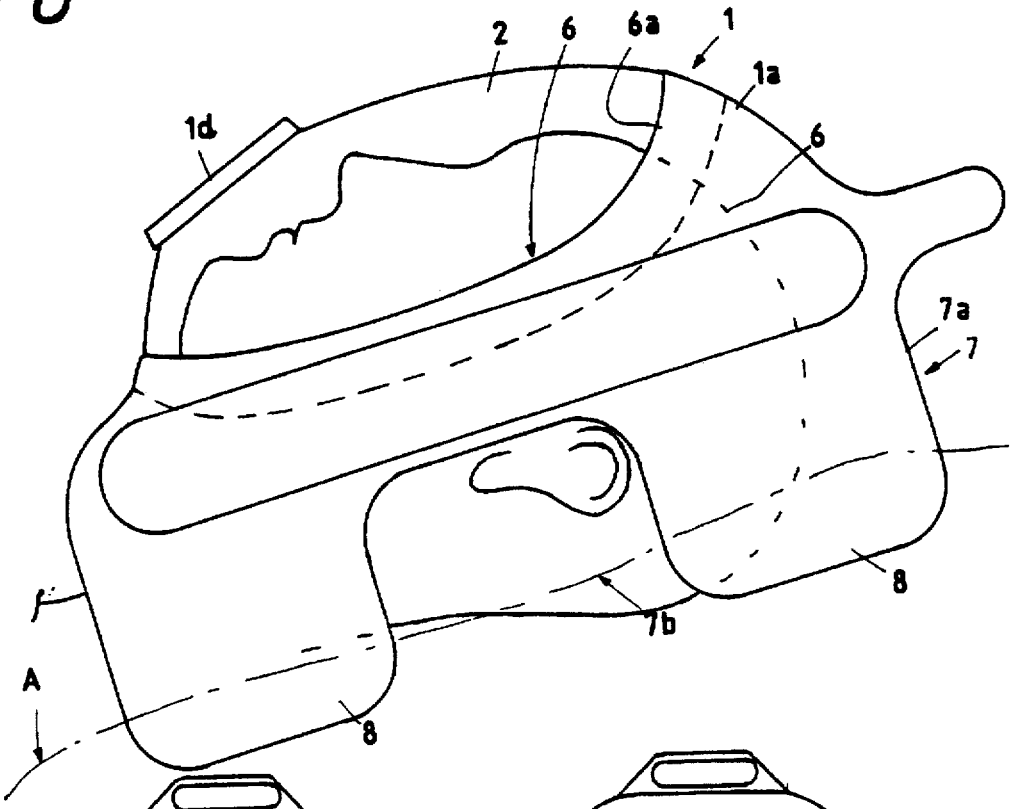
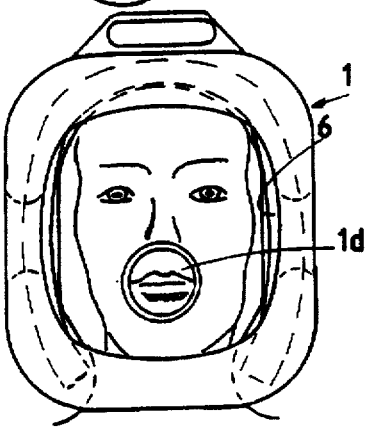
FIG.7
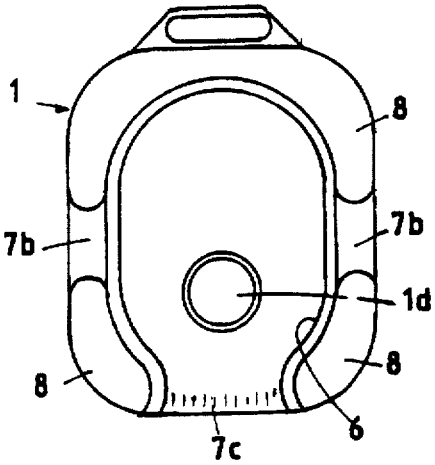
FIG.8

BREATHING MASK

This application is a continuation application under 37 C.F.R. 1.62 of prior application Ser. No. 08/244,232, filed as PCT/NO92/00186, Nov. 26, 1992 published as WO93/10858, Jun. 10, 1993 abandoned on Jan. 11, 1996.

The present invention relates to a breathing mask to be placed on a user's head for use during evacuation, relief and/or rescue operations, comprising a face piece with a visual field/window, flexible sealing means to seal against the user's face in front of the user's ears for defining an airtight chamber, a pressure gas container for breathing gas, and having a pressure reduction valve and a manual and/or automatic release valve for supply of breathing gas to the mask's airtight chamber, as disclosed in the preamble of the following independent claim 1.

In fire accidents over the years, people's lives have been lost as a result of smoke poisoning. In many cases this has happened under circumstances where only a few minutes' supply of fresh air to breathe could have enabled these exposed persons to get to safety. This might involve continued occupation of a room with heat and smoke accumulation, and evacuation out a window as soon as a fire ladder or other rescue equipment has been put in place, or escaping through smoke-filled corridors/staircases to fresh air or to smoke-free areas in a building or ship.

The area of use for the present invention thus pertains to evacuation/escape in the case of fire and/or accumulation of smoke or poisonous gas in residences, hotels, ferries, hospitals, homes for the aged, or other institutions, industrial buildings, etc.

As relevent areas of usage, there may also be mentioned easily deployable and portable respiration and protective equipment for ambulance drivers, police, etc., on assignments in a foul-smelling atmosphere or in connection with dangerous gases. A further area of use is as preparedness equipment for guards and operators at chemical plants, facilities in the oil and petroleum industry, oil installations, ships and other means of transport.

There are previously known helmets/hoods having a supply of compressed air to assist for evacuation purposes during smoke accumulation in the case of fire, etc.

A helmet or hood of this type is known, for example, from WO 91/00120, which relates to a breathing gas container disposed in the upper part of the helmet to be supported against the user's head, and walls projecting downward from the breathing gas container comprising, respectively, a compressed air reduction valve and release valves for conducting the air into the chamber of the helmet, and a window. This hood/helmet may easily be slid down over the head of the user in the actual crisis situation, whereby the individual gains the opportunity to make an escape, or a rescue squad is able to carry out a mission in foul-smelling atmosphere or dangerous gases.

During recent years research has been conducted in connection with evacuation operations in connection with fires where it is necessary to protect people against smoke-filled and gas-filled atmospheres. It has been shown that aside from providing for a supply of breathing gas, it is also of crucial importance that the user be able to perceive sound, namely information from persons or from loud-speakers to provide guidance in the situation at hand. This is in contrast to the previous belief that it would be impossible for people to make use of such information due to a panic situation. We now know that panic occurs first when people are left standing without information as to how they should conduct themselves. This has led to the aforementioned recognition that it is important that the user of respiratory and protective equipment must be able to perceive sound and thereby oral information.

Therefore, instead of the aforementioned respiratory and protective equipment in the form of a helmet/hood, it is relevant to design the equipment as a breathing mask, such as is mentioned in the above introduction, for placement on a user's head, with the ears being exposed in order to be able to receive oral information. Such breathing masks are previously known in principle from gas masks having carbon filters. There is also known from, for example, U.S. Pat. No. 1,105,127 a breathing mask of the mentioned type where the breathing gas container is connected to the breathing mask by a hose, said breathing gas container being securely fastened to the user's back or suspended around the user's neck. Such equipment could come into conflict with other rescue equipment such as buoyancy suits, life jackets and other garments during use. To avoid such conflicts, it would be recommendable that the breathing gas container be disposed within the breathing mask itself, as known from U.S. Pat. No. 4,157,090, which is provided with a breathing gas container positioned on the actual face mask, presumably on the front part thereof, thus constituting a weight increase thereon, requiring an improved means of fastening the protective mask onto the user's head. This is in contrast to the previously mentioned known hood/helmet where the breathing gas container is disposed on the user's head and supported thereby such that no problems arise with regard to the fastening of the helmet/hood.

The purpose of the present invention is thus to provide a breathing mask of the type mentioned in the above introduction, which takes into consideration the disadvantages of breathing masks according to the aforementioned prior art, which is achieved according to the invention by means of the characterizing features disclosed in the characterizing clause of the following claim 1 and the subsequent dependent claims.

There is thus provided a breathing mask with a sealing means, which mask and sealing means are connected to a breathing gas container that is annular in shape or forms an open ring positioned around the user's face, and which extends over the user's head and is supported thereby. The entire apparatus is secured by means of straps running from the breathing mask and behind the user's head.

With the above mentioned design of the breathing mask, one achieves, in addition to the exposure of the user's ears for reception of oral information, also the possibility of using the breathing mask together with conventional models of life jackets, since the breathing mask does not contain any components separated therefrom, such as hoses and breathing gas containers, which, respectively, extend along the neck and over the shoulders, and are suspended over the shoulders or around the neck.

As is known, life jackets have a large buoyancy member behind the neck in order to maintain a person in the sea in a floating position with the face upward. This is relevant in connection with evacuation from ships/structures in the sea where it is necessary to protect oneself from noxious gases both during the escape itself and after eventual jumping or being lowered into the sea with burning oil or accumulation of gas on the sea surface.

A breathing mask in accordance with the invention is relatively simple to produce and to use, and it could thus be placed in relevant locations such as hotel rooms, cabins on ferries, at easily accessible places in hospitals, schools, etc., and on marine structures such as, for example, drilling platforms.

A simple breathing mask according to the invention may thus be disposed in large number at appropriate locations, said equipment being capable of saving lives in cases of emergency where it is a matter of only a brief period of time to be able to escape from smoke or gas-filled areas to areas with an innocuous atmosphere.

A further aspect of the present invention is to provide a breathing mask to be used by bed-ridden persons while they are being transported for evacuation in wheeled beds or by means of pulling mattresses or transporting patients or injured persons on stretchers, from areas having a noxious atmosphere to areas of non-injurious atmosphere.

This is achieved according to the invention by providing a breathing mask, according to claim 1 and as further specified in the subsequent dependent claims, with a rearwardly directed support means at the circumference of the breathing mask to support the mask against a base surface when the breathing mask is placed over the face of the reclining patient/user.

Figure 2:
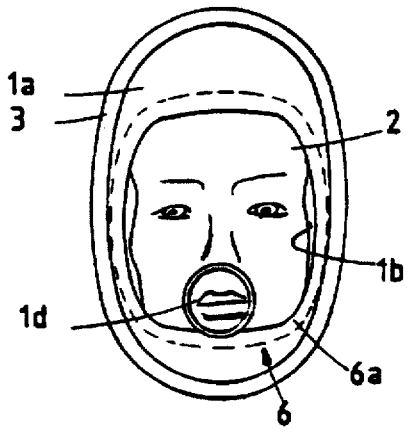
Figure 4:
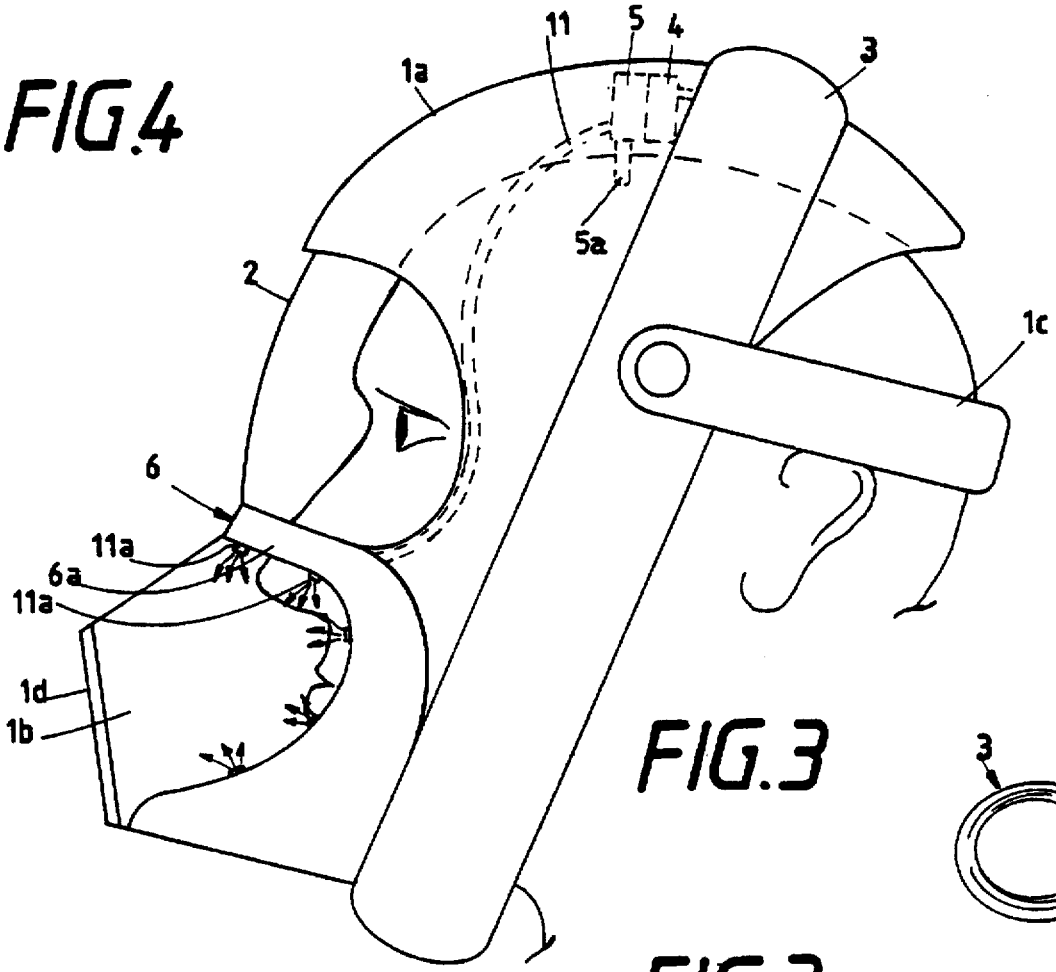
Figure 3:
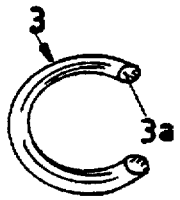
Figure 3A:
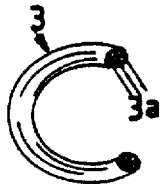
Figure 3B:
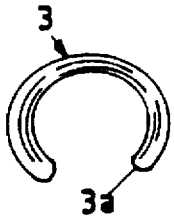
Figure 5:
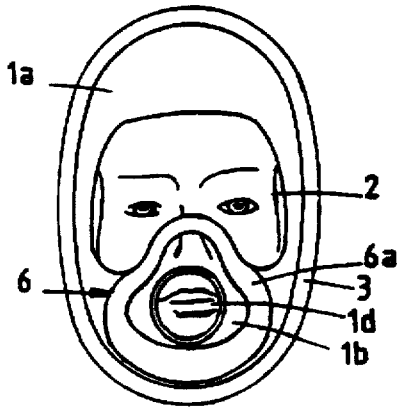

The breathing mask according to the invention will be described in more detail in the following, with reference to a schematic embodiment example of the breathing mask shown in the drawings, where FIG. 1 shows a lateral view of the breathing mask placed on a user, FIG. 2 shows direct front view of the same, FIGS. 3*a*, *b* and *c* show three different embodiment forms of the pressure gas container in the form of, respectively, a closed or an open ring, FIG. 4 shows the same as FIG. 1, but with the airtight chamber for breathing gas restricted to the area of the nose and mouth, FIG. 5 shows a front view of the breathing mask, FIG. 6 shows a lateral view of the breathing mask equipped with supporting projections and positioned over the face of a reclining person, FIG. 7 shows a front/top view of the breathing mask, and FIG. 8 shows a view from the rear/underside of the same.

FIG. 1 in the drawings shows the breathing mask 1 placed on the user's head and fastened with a head strap 1*c*. Breathing mask 1 comprises a face piece 1*a* with a visual field/window 2, flexible sealing means 6 to seal against the user's face in front of the user's ears, a pressure gas container 3 for breathing gas and a pressure reduction valve 4 and manual and/or automatic release valve 5 with control lever 5*a* for supplying breathing gas to chamber 1*b* of mask 1 rendered airtight with the aid of the flexible sealing means 6. Sealing means 6 is shown in FIGS. 1 and 2 to encircle the entire face of the user in sealing contact therewith, such that the airtight chamber extends from the chin area over the mouth and nose section, including the eyes and forehead section. Said head strap 1*c* is fastened in a suitable manner, for example by means of pressure snaps, or is simply pivotably secured to pressure gas container 3. The head strap may be elastic to adapt to various head sizes, or it may be regulated with respect to length by various means that are known per se. Pressure gas container 3 consists of one or more closed, communicating tubes 3*a* which are bent into a closed or open ring to encircle the user's face in front of the user's ears. Said one or more communicating tubes 3*a* may be built into a material to form an annular unit having a shape adapted to a user's face in order to stretch over the user's skull and down along the face in front of the ears and in under the user's chin section. Pressure gas container 3 thus constitutes a relatively rigid body that is supported by the user's skull and is thus suitable as a support for face piece 1*a* of breathing mask 1 as well as sealing means 6.

Sealing means 6 may be made composed of an inflatable, annular cavity or a hose 6*a*.

The cavity/hose 6*a* of sealing means 6*a* in one embodiment form may be separately connected by a hose 10 to the breathing gas supply 9 to the airtight chamber 1*b* of mask 1, and may be inflated by tripping the release valve 5 with the aid of control lever 5*a* to supply breathing gas to the airtight chamber 1*b* of mask 1.

In a second embodiment form, the cavity/hose 6*a* of sealing means 6 may be connected between and in series with pressure reduction valve 4 and airtight chamber 1*b* of mask 1 by means of a hose 11, for automatic through flow and inflation of the cavity/hose 6*a* of sealing means 6 on opening of the breathing gas supply to the airtight chamber 1*b* with the aid of release valve 5, as shown in FIG. 4, and where the air flows out into said chamber 1*b* via nozzles 11*a*.

In an alternative embodiment form of the breathing mark as shown in FIGS. 4 and 5, the sealing means 6 is positioned in the lower part of the face place 1*a* in such manner as to come to rest only around the user's chin section and cheek as well as over the user's nose section, thereby defining a smaller airtight chamber 1*b* than the larger airtight chamber 1*b* shown in FIG. 1. Thereby, any formation of fog or dew on window 2 of breathing mask 1 is avoided, said window 2 thus lying outside the airtight chamber with its supply of breathing gas as well as the infusion of moist expiratory air. Because airtight chamber 1*b* of breathing mask 1 is supplied with breathing gas under pressure from pressure gas container 3, the mixed air in airtight chamber 1*b* must necessarily be able to escape past flexible sealing means 6. This means that the sealing capability of sealing means 6 is not critical, since the overpressure in the airtight chamber 1*b* will constantly prevent the penetration of harmful gas thereinto because the mixed air, as a result of said overpressure, forces its way out through any potential leakage points in sealing means 6. Of course, a pressure relief valve may, if necessary, be provided in the face piece of the actual breathing mask 1 to release used mixed air.

To facilitate placement of breathing mask 1 on the face of a person/patient/injury victim lying on his back, breathing mask 1 is equipped with a rearwardly directed support means 7 at the circumference of breathing mask 1, or more specifically breathing gas container 3, to support breathing mask 1 against a base surface A as shown in FIG. 6. Support means 7 here constitutes an annular wall 7*a* having recesses 7*b*,7*c* for, respectively, the ears and neck of the user. The patient/injured person is hereby able to perceive and hear information and thus comprehend the actions of the assisting personnel in connection with a evacuation operation. This, of course, is on the condition that the patient/injured person is conscious.

Support means 7 may in an alternative embodiment be composed of at least three projections 8 mutually spaced around the circumference of breathing mask 1 for, respectively, exposing the user's ears and enclosing the user's neck. Breathing mask 1 with said projections is also shown viewed from the front or above in FIG. 7 and viewed from the rear/underside in FIG. 8.

The previously mentioned pressure reduction valve 4 and release valve 5 may be arranged in a number of different ways, including that indicated in FIG. 1, namely at the upper part of pressure gas container 3, i.e., at the user's skull. In this way, for example, pressure reduction valve 4 may be constructed together with release valve 5 for automatic release of the latter by placement of the breathing mask on the user's face, control lever 5*a* for said release valve being actuated by contact with the user's head.

Of course, release valve 5 may if desired be designed for manual operation, with control lever 5*a* being placed at a convenient location.

In FIG. 1 there is also indicated an alternative placement of said pressure reduction valve 4 and release valve 5, namely down at the lower part of the pressure gas container by the user's chin section.

Outflow of breathing gas from pressure reduction valve 4 via release valve 5 can take place in a number of suitable ways. For example, the outflowing breathing gas may be directed against window 2 of breathing mask 1 in order to prevent/decrease the formation of dew or fog with the embodiment form according to FIG. 1. A breathing gas hose 9 may thus be positioned from said valve arrangement 4,5 and forward to the upper part of window 2 for downward flow of breathing air, or at the lower section of the window and, thereby, upward flowing breathing air, or from the sides thereof.

This problem is avoided in the embodiment form according to FIGS. 4 and 5, where airtight chamber 1*b* encloses only the nose and mouth section of the user.

Face piece 1*a* of breathing mask 1, and optionally also the visual field/window 2, may be constructed of flexible material in order thereby, inter alia, to reduce the size of the breathing mask in folded or packed state. This can have significance with respect to both the question of preparedness in storing a plurality of breathing masks, and also for carrying along the individual breathing mask during an alarm/rescue operation.

To facilitate the communication of speech from within the breathing mask during use, a speech membrane 1*d* may be provided in face piece 1*a* directly outward of the user's mouth section.

To prevent the breathing mask from becoming unusable by virtue of possible leakage occurring in pressure gas container 3 or pressure reduction valve 4, or alternatively in release valve 5, said pressure gas container 3 may be divided into groups, each of which is connected with its respective pressure reduction valve 4 and release valve 5. In this respect it is expected that at least one group will remain intact so that the breathing mask will provide protection, if only for a shorter period of time. Said groups consisting of one or more communicating tubes 3*a* may be arranged alongside each other within the total pressure gas container 3, or in sequence in the longitudinal direction of pressure gas container 3. Said groups may be embedded in a support body, which groups and support body constitute the previously mentioned closed or open ring to encircle the user's face in front of the user's ears, and to which support body the face piece 1*a* together with sealing means 6 are attached.

We claim:

1. A breathing mask, comprising;

a face piece having a window, flexible sealing means operative to seal against a user's face and extending in front of the user's ears to define an airtight chamber, a container for pressurized breathing gas, and a pressure reduction valve and a release valve for the supply of breathing gas to said airtight chamber, said container for pressurized gas comprising a closed tube in the form of a ring adapted to encircle the user's face in front of the user's ears, said pressurized gas container being attached to said flexible sealing means at a position entirely within said face piece, and said sealing means connected in series with said pressure reduction valve and said airtight chamber of the mask, thus providing automatic inflation of said sealing means on opening of the breathing gas container and through flow to said airtight chamber.

2. The breathing mask according to claim 1, wherein the flexible sealing means encircles the nose and mouth section of the user and defines said airtight chamber.

3. The breathing mask according to claim 1, wherein said face piece is constructed of foldable, flexible material.

4. The breathing mask according to claim 3, wherein said window also is constructed of foldable, flexible material.

5. The breathing mask according to claim 1, wherein a speech membrane is provided in the face piece.

6. The breathing mask according to claim 1, wherein said closed tube is provided by at least two separate tubes, said separate tubes being embedded in a support body and connected individually to respective release valves.

7. The breathing mask according to claim 6, wherein a pressure-reduction valve is connected between each group of said separate tubes and their respective release valves.

8. The breathing mask according to claim 1, wherein said pressure gas container forms a closed ring.

9. The breathing mask according to claim 1, wherein said pressure gas container forms an open ring.

10. The breathing mask according to claim 1 and further including a rearwardly directed support member connected to a circumference of the breathing mask, and operative to support said breathing mask against a base surface when placed over the face of a user lying on said base surface.

11. A breathing mask, comprising:

a face piece having a window;

flexible sealing means operative to seal against a user's face and extending in front of the user's ears to define an airtight chamber;

a rearwardly directed support member connected to a circumference of the breathing mask and operative to support said breathing mask against a base surface when placed over the face of the user lying on said base surface;

said airtight chamber encircling the user's eyes and nose in such a way that the user's eyes and nose become situated within said airtight chamber;

a pressure gas container for breathing gas;

said pressure gas container being attached to said face piece; and a pressure reduction valve and a release valve for the supply of breathing gas to said airtight chamber, wherein said pressure reduction valve releases a downward directed airflow that sweeps along both the inside of said window and a part of the user's face around the user's eyes, to cool this part of the user's face and keep said window free from fog.

12. The breathing mask according to claim 11, wherein the support member is composed of an annular wall having recesses for accommodating, respectively, the ears and neck of the user.

13. The breathing mask according to claim 11, wherein the support member is composed of at least three projections mutually spaced around the circumference of said breathing mask, respectively encircling the user's ears and encircling the user's neck.

* * * * *